US005336400A

United States Patent [19]

Patrice

[11] Patent Number: 5,336,400

[45] Date of Patent: Aug. 9, 1994

[54] POOL SKIMMER DIVERTER ASSEMBLY

[76] Inventor: Andre M. Patrice, 6724 Arthur Street, Orleans, Ontario, Canada, K1C 1J3

[21] Appl. No.: 12,922

[22] Filed: Feb. 3, 1993

[51] Int. Cl.[5] ..... E04H 3/16

[52] U.S. Cl. ..... 210/169; 210/242.1; 4/490

[58] Field of Search ..... 210/169, 242.1, 416.2; 15/1.7; 4/490

[56] References Cited

U.S. PATENT DOCUMENTS

| | | | |
|---|---|---|---|
| 3,152,076 | 10/1964 | Kreutzer | 210/169 |
| 3,774,767 | 11/1973 | Field | 210/169 |
| 4,068,327 | 1/1978 | Heinlein | 210/169 |
| 4,225,436 | 9/1980 | Cseh | 210/169 |
| 4,379,749 | 4/1983 | Roth | 210/169 |
| 4,455,695 | 6/1984 | Mikhel | 210/169 |
| 4,734,189 | 3/1988 | Page, Jr. | 210/169 |
| 4,789,470 | 12/1988 | Wards | 210/169 |
| 4,904,379 | 2/1990 | Ward | 210/169 |
| 4,960,514 | 10/1990 | Paskert | 210/169 |
| 5,059,314 | 10/1991 | Beckman | 210/169 |

*Primary Examiner*—Peter A. Hruskoci
*Assistant Examiner*—Robert J. Popovics
*Attorney, Agent, or Firm*—Dressler, Goldsmith, Shore & Milnamow, Ltd.

[57] ABSTRACT

Disclosed is apparatus for enhancing the surface cleaning of a swimming pool having a skimmer inlet in a wall of the pool and the pool having peripheral water movement generally along the wall. A first rigid plate, having an upper and lower edge and inner and outer ends is supported by a support generally vertically adjacent the skimmer inlet such that an upper edge of the first plate is above water level, the inner end of the first plate extends generally vertically downward intermediate the sides of the skimmer inlet and the plate extends inwardly at an angle with the pool wall in a direction opposite the direction of water movement. The lower edge of at least the inner end of the first plate is substantially adjacent the bottom edge of the skimmer inlet. A second plate extends outwardly from the first plate at an angle thereto such that when the apparatus is in operative association with the skimmer inlet, the second plate slants in the direction of water flow, has its lower edge below water level and its outer end downstream of the outer end of the first plate. Debris on the surface of the water or close to it is directed by the first plate to the skimmer inlet. The two plates also cause eddy currents behind the first plate, which current further directs water carrying debris toward the wall of the pool and to the downstream path of the skimmer inlet. With the end of the first plate intermediate the sides of the skimmer inlet, water can still enter the skimmer from behind the first plate as well as in front of it. The speed with which the surface of a pool is cleaned is significantly enhanced.

11 Claims, 3 Drawing Sheets

POOL SKIMMER DIVERTER ASSEMBLY

FIELD OF THE INVENTION

This invention relates to a device or apparatus for enhancing the operation of the skimmer apparatus associated with swimming pools and more particularly pertains to a device or apparatus which is adapted to be detachably mounted adjacent the skimmer opening or inlet in the side wall of a swimming pool to enhance the cleaning and removing of debris, particles and dust on the water surface and adjacent the water surface of the swimming pool.

BACKGROUND OF THE INVENTION

Swimming pools have systems for filtering and recirculating water to clean and remove debris, particles and dust floating on or adjacent the water surface of the pool. In backyard type pools, this system is most often in the form of apparatus including one or more outlets in the side wall of the pool at water height. Surface water in the pool is pulled toward the outlet as a result of the suction side of a water recirculation system. This outlet is commonly known as a "skimmer" inlet and surface water enters the skimmer inlet and is recirculated to the pool after passing through a basket type strainer that collects relatively large debris (collectively referred to herein as skimmer apparatus). Smaller particles and dust are filtered out at a filter point using filters of sand, cartridge or diatomaceous earth-type filters. Filtered clean water is recirculated to the swimming pool generally by way of nozzles associated with the side walls of the pool, at least some of the nozzles being angled in such a way that a general counterclockwise flow of water (in the northern hemisphere) takes place.

Other means of cleaning particles/debris from the surface of the pool are common and these usually include a suction device supported by a long pole which is selectively connected by a hose to a separate part of the skimmer apparatus so that the "suction" associated with the skimmer apparatus will "vacuum" the debris or particles from the surface of the pool when the pole supported suction device is held and manipulated by an operator.

These latter devices are also often used to "vacuum" the walls and bottom of a pool to remove deposited debris, particles and dust therefrom. Obviously the more effective the surface "skimmer" system is, the less depositing there is of debris, particles and dust on the walls of the pool.

Accordingly, there is a need for a device which will enhance the effectiveness of the skimmer system in outdoor backyard pools.

SUMMARY OF THE INVENTION

The invention in one aspect broadly provides apparatus for enhancing the surface cleaning of a swimming pool having a skimmer inlet in a wall of the pool, the inlet having side edges, top and bottom edges and the pool having peripheral water movement generally along the wall comprising a first rigid plate having an upper edge, lower edge and inner and outer ends, a support for supporting the first plate generally vertically adjacent the skimmer inlet such that the upper edge of the first plate is above water level, the inner end of the first plate extends generally vertically downward intermediate the side edges of the skimmer inlet and the plate extends inwardly at an angle with the pool wall in a direction opposite the direction of water movement, the lower edge of at least the inner end of the first plate being substantially adjacent the bottom edge of the skimmer inlet.

The invention also provides a method of enhancing the surface cleaning of a swimming pool by skimmer means having a skimmer inlet with side edges and a bottom edge, the pool having water movement around the periphery of the pool comprising providing a skimmer enhancing apparatus comprising support means and a first plate connected to the support means and extending generally vertically, the first plate having upper and lower edges and inner and outer ends, mounting the support means relative the pool periphery so as to locate the upper edge of the first plate above water level, the inner end of the first plate closely adjacent the skimmer inlet and intermediate the side edges thereof and such that the first plate extends inwardly of the pool wall at an angle and in a direction opposite water movement and with the lower edge of at least the inner end thereof substantially adjacent the bottom edge of the skimmer inlet.

Preferably, the apparatus further includes a second plate supported by the support and extending generally perpendicular to the first plate and outwardly from the first plate, slanting in the direction of water flow and also having its lower edge below water level.

More particularly, the invention relates to a generally rigid device or apparatus that, once detachably secured or mounted to the edge or coping of any shape or size of swimming pool structure and located so that it is directly over the location of a skimmer inlet, will dramatically increase the cleaning effectiveness of the skimmer system including the strainer basket and filter apparatus. While the inventive apparatus remains installed in association with the swimming pool, it substantially reduces the need for cleaning of the walls of the swimming pool. This is achieved by diverting surface debris, particles and dust that would otherwise have remained on the water surface long enough to sink to the bottom or stick to the side walls of the swimming pool to the skimmer.

Although the inventive apparatus provides a fast and effective method of cleaning swimming pool surface water as noted, it cannot divert all of the pool water within the time the floating debris, dust and particles has circulated once around the swimming pool perimeter. In order to further ensure speed of water surface cleaning, the inventive device preferably is constructed such that surface water having debris, particles and dust which has initially by-passed the first plate is diverted or directed by eddy currents more quickly to the wall of the pool and possibly to the downstream side of the divided skimmer inlet or to the wall of the pool for subsequent catching by the apparatus and next flow around the pool wall. Thus, with the recirculating water flow nozzles aimed correctly within the swimming pool structure, the debris, particles and dust on or adjacent the surface are more quickly aligned within the cleaning path of the first plate, thereby being more quickly removed from the swimmming pool water surface before they have a chance to settle in and sink to the bottom or stick to the side walls of the pool.

Thus, the invention in a preferred aspect provides an apparatus or device which is detachably mounted to the side of a pool in association with the skimmer inlet and which enhances the effectiveness of the skimmer by not only directing additional surface water to the skimmer, but through eddy currents, causes surface water not initially directed to the skimmer outlet by the device to tend to flow toward the wall of the pool to be caught by the downstream portion of the skimmer opening or being the device in the next flow around the side of the pool.

BRIEF DESCRIPTION OF THE DRAWINGS

FIG. 5 is an aboveground pool and FIG. 6 an inground pool without coping.

DESCRIPTION OF THE PREFERRED EMBODIMENTS OF THE INVENTION

Figure 1:
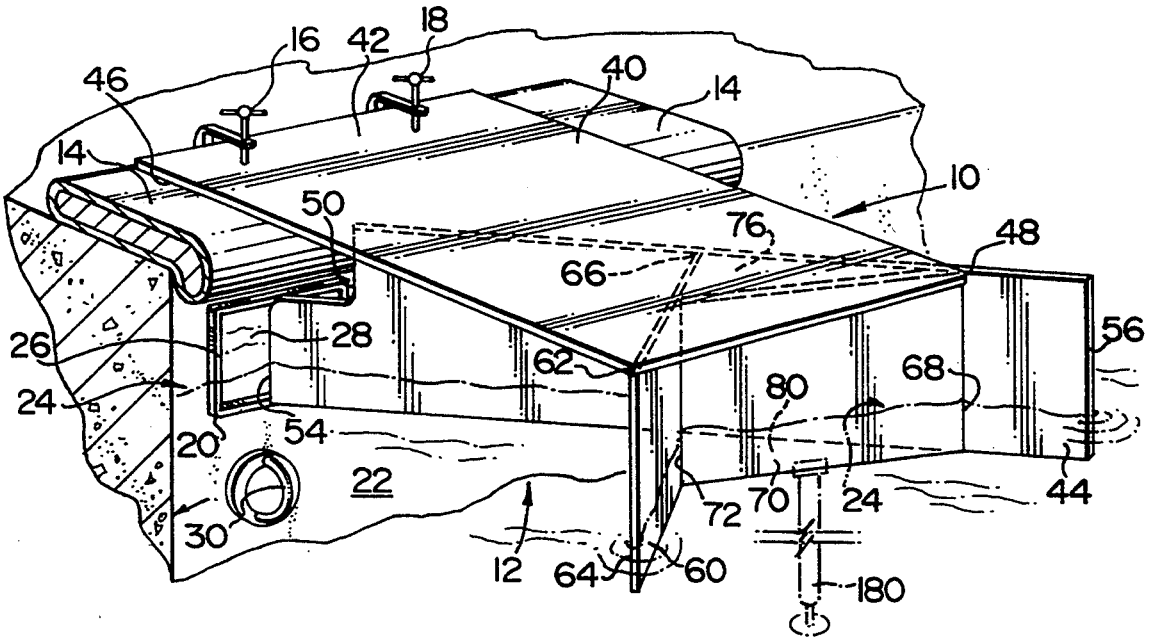
FIG. 1 is a perspective view of the inventive device or apparatus detachably secured to the side of a swimming pool shown schematically.

The device 10 is shown detachably mounted to the top edge of swimming pool 12 above coping 14 by "C" clamps 16 and 18 and is associated with "skimmer" inlet or opening 20 in the pool perimeter wall 22. Coping 14 and the shape of the skimmer opening 20 (rectangular) is for illustration purposes only and the device 10 is adapted for use with any shaped pool, e.g. circular, kidney and the like having a surface skimmer. Surface skimmers are however invariably rectangular in shape and located such that the surface of the water 24, i.e. the water height, is generally within the bottom half of the skimmer inlet 20. Skimmer inlet 20 is rectangular having peripheral molding 26 and interior conduit 28 leads to a strainer device (not shown) and a water recirculating pump and filter apparatus (not shown). These latter devices are well known to those skilled in the art and further details thereof are not required for understanding the invention. Water is returned to the pool from the filter apparatus through various nozzles located below the surface of the water and at least some of the nozzles are capable of being aimed or directed such as to cause a counterclockwise flow of water in the pool adjacent the perimeter wall of the pool. One such nozzle 30 is shown in FIG. 1.

The inventive device comprises a generally horizontal support means shown in the form of plastic sheet or plate 40 which may be clamped at side edge 42 to coping 14 by "C" clamps 16 and 18.

Extending perpendicularly downwardly from support 40 is deflecting sheet or plate 44 and the direction of second plate 44 is generally in a diagonal direction of support plate 40, in the direction of corners 46 and 48. Deflecting plate 44 has cut out shoulder 50 to accommodate the inner edge 52 of coping 14 and has inner end 54 of a height to at least vertically bisect the skimmer opening 20. The width (depth) of plate 44 is such that it will extend to substantially below the upper edge of the skimmer and preferably slightly below the bottom molding 26 of the skimmer opening 20. Plate 44 extends beyond the corner 48 of support 40 and has outer end 56.

Also extending generally vertically downwardly from support 40 is plate 60 which extends from corner 62 of support 40 inwardly from end 64 to meet plate 44 at 66 generally illustrated to be at right angles. There is a further plate 70 which extends vertically downwardly from support plate 40 between corner 48 of support 40 and plate 44 at 68, plate 60 meeting plate 60 at 72.

The upper edges of the plates 44, 60 and 70 are secured to the support plate 40 by any appropriate means, such as glue and are also secured together at their respective juncture points 66, 68 and 72. It will be apparent therefore that a closed inverted triangular box 76 is formed by plates 44, 60 and 70, box 76 providing structural strength to device 10. Further, box 76 provides an air pocket 80 between plate 40 and water surface 24 which will assist in supporting device 10 at its outer end on water surface 24. Plates 40, 44, 60 and 70 may all be made of suitable plastic sheet material, glued or heat welded together as is known in the art.

Figure 2:
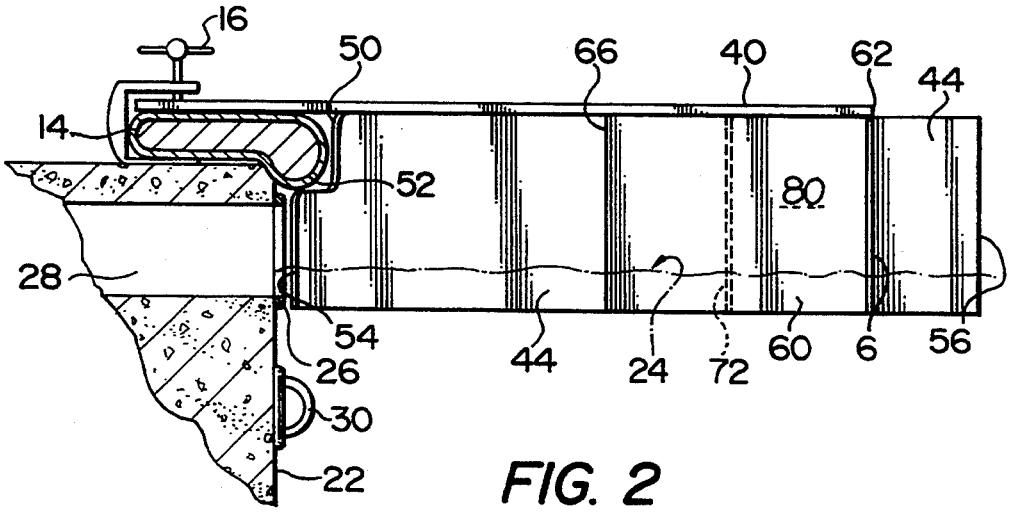
FIG. 2 is a side view of the device as shown in FIG. 1 with part of the pool wall shown in section.
Figure 3:
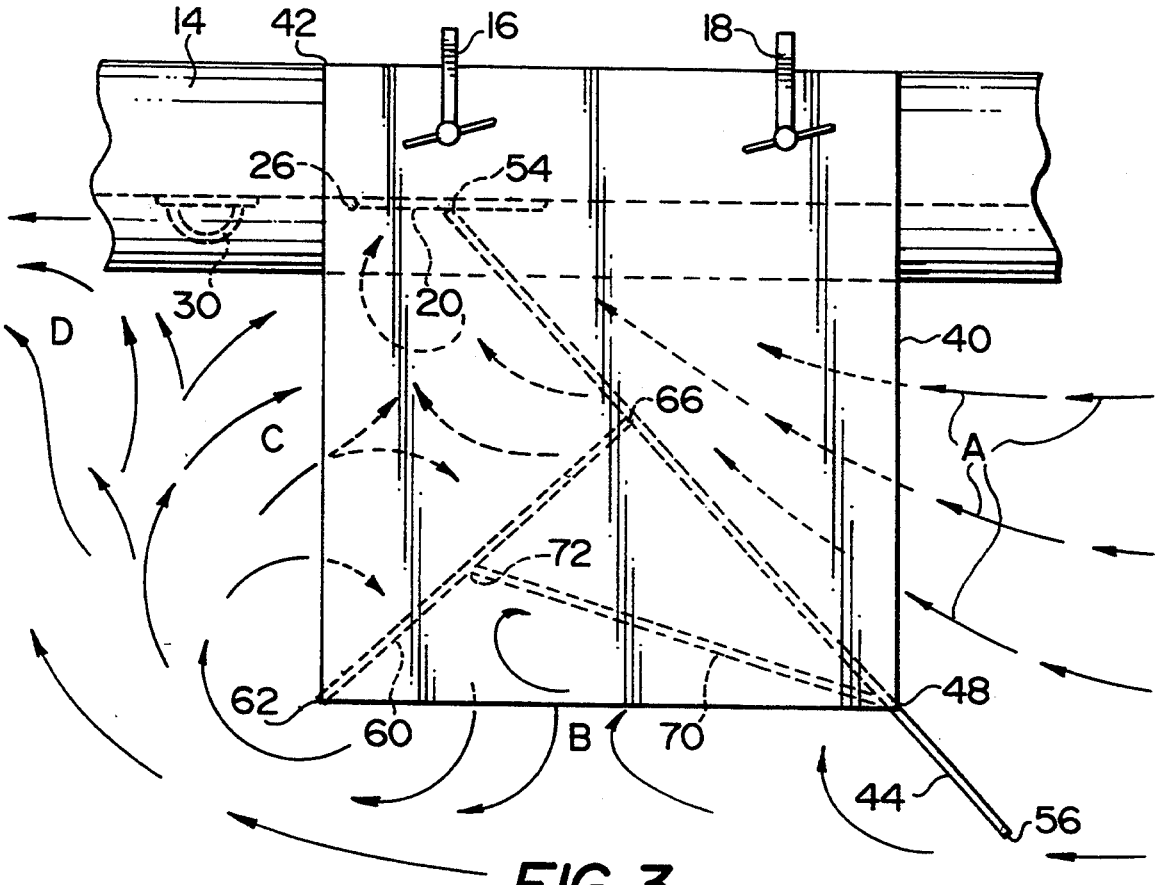
FIG. 3 is a top view of the device as shown in FIG. 1.

In operation, device 10 is mounted or secured to coping 14 at the peripheral edge of the pool 12 by clamps 16 and 18. The mounting is such that the inner end 54 of plate 44 generally bisects skimmer opening 20 as shown in FIGS. 2 and 3. Box 76 formed by the plates 44, 60 and 70 define air pocket 80 which supports the device 10 on the water surface inward of the edge of pool 12 thereby reducing any cantilever stress that might otherwise occur between clamps 16, 18 and coping 14.

FIG. 3 illustrates a top view of device 10 and shows the direction of the flow of water (from right to left) as illustrated by arrows A. This flow is generated by nozzles such as nozzle 30 (FIGS. 1 and 3) at certain locations on the peripheral wall of the pool which nozzles return water initially entering the skimmer inlet 20 from the filter system (not shown) to the pool. Surface water directly in the face of plate 44, shown by arrows A, is deflected or directed toward the forward half portion 90 of the skimmer inlet 20 and it will be appreciated that a substantial increase in the amount of surface water is diverted and directed to skimmer inlet 20 than is caught by the skimmer without my device. However, it should be appreciated that inner end 54 of plate 44 is intermediate the lateral sides of skimmer opening 20 and therefore the rearward portion 92 of skimmer opening 20 continues to cause water behind plate 44 to be drawn and sucked into the filter system. Thus, eddy currents are caused to develop behind plates 44 and 60 because of the projecting outer ends 56 and 64 of plates 44 and 60, which eddy currents are in a clockwise direction, as shown by arrows B and C. These eddy currents tend to draw the flow of water otherwise passing the end 56 and 64 of plates 44 and 60 toward the side 22 of the pool. With the device causing the surface water behind plate 44 to eddy in such manner as to draw the water (not otherwise diverted or deflected by plate 44) toward the side of the pool, debris, particles and dust on or adjacent the water surface is drawn to the wall 22 (see arrows D) where its chances of being caught by the downstream side of the skimmer wall is enhanced and/or by plate 44 in the next flow around of perimeter water is greatly enhanced.

Accordingly, not only does device 10 significantly enhance the amount of surface water diverted or deflected to the skimmer 20, but it significantly enhances the chances of debris, particles and dust still on or adjacent the surface being caught the next flow around since the debris, particles or dust on the surface, which is not deflected or diverted the first time, is directed to the periphery of the pool after skimmer opening 20.

Figure 4:
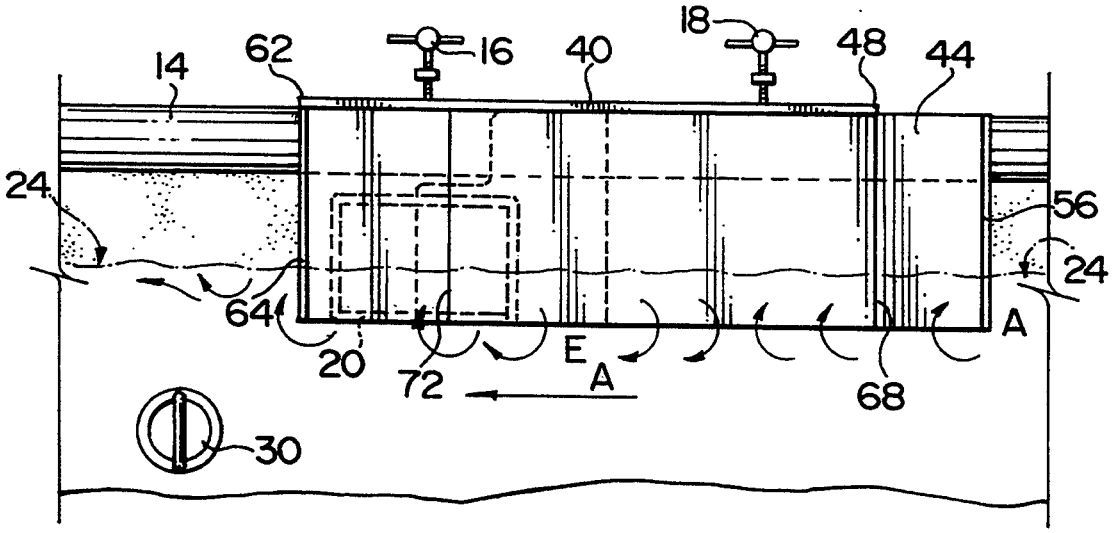
FIG. 4 is a front view of the device as shown in FIG. 1.

I have also found that the depth of the plates 44 and 60 in the water causes eddy currents in a vertical direction (see arrows E, FIG. 4) which also enhances the skimming action with respect to debris, particles and dust floating just below the surface of the water. This debris, particles and the like is brought to the surface and accordingly the chances of it being picked up during the next flow around is enhanced. It should be appreciated that in view of the fact that the flow of water, as represented by arrows A and D caused by the recirculation system is not fast, the eddy currents set up by my device—arrows B, C and E, do not significantly stir or mix up the water but tend to simply cause the flow of the water to be re-directed whereby the effectiveness of the skimmer is significantly enhanced.

Further, the location of end 54 of plate 44 in use, preferably vertically bisects skimmer inlet 20, although end 54 may be located on either side of the center of skimmer inlet 20. With end 54 forward (upstream) of the center of inlet 20, less formation of eddy currents is developed but greater is the flow of diverted water in the inlet. With end 54 rearward (downstream) of the inlet 20 center, more eddy current is developed with less speed of the deflected flow into the skimmer.

With particular reference to FIG. 3, an exemplary embodiment has support plate 40 about 15 inches (about 38 cm) between corners 62 and 48. Second plate 44 extends outwardly from the corner 48 about 11½ inches (about 27 cm) and the total length of plate 44 is about 30 inches with the cut-out portion 50 to accommodate the coping being about 7 inches (about 18 cm) long and 2 inches (about 8 cm) deep. Plate 60 is about 10½ inches (26 cm) long and plate 70 is about 11½ inches (28 cm). The distance from the juncture 72 of plates 60 and 70 to corner 62 is about 7 inches (16 cm). It will be appreciated that the width of the coping 14 may make it desirable to extend plate 40 to be 25 inches or more in length. The preferred angle "alpha" ($\alpha$) between the plane of the skimmer opening 20 and the plane of plate 40 is 45° as this appears to provide good deflection/diversion of surface water and yet provide the most effective eddy currents which cause debris, particles and dust in or on passing surface water to be drawn around the side of the pool. However, angles for $\alpha$ of between 30° and 60° are possible with varying degrees of effectiveness.

Further, it will be appreciated that the longitudinal extent of plates 44 and 60 can be varied but it is preferred that plate 60 not extend outwardly (inwardly of the pool) as far as plate 44 as will be evident from FIG. 3. This configuration provides for effective eddy current flow development behind the outer end 56 of plate 44 (arrows B) leading to the eddy currents being further enhanced behind the outer end 68 of plate 60 (arrows C).

It will also be appreciated that flotation causing pocket 80 could be partially filled with foam and indeed any form of flotation device is contemplated, provided it does not interfere with the flow of water. By way of example, a triangular piece of styrofoam of the size of box 76 could be glued or fastened to the adjacent sides of plates 44 and 60, the foam having an outer flat surface effectively defining the surface defined by plate 70.

Some pools having coping which slopes downwardly toward the pool. In this case, a wedge may be used or form part of the support plate in order to maintain support 40 generally horizontal in the water and relieve stress otherwise occurring at the location of clamps 14 and 16. With pools without coping, plate 40 may be designed, extending the length as necessary so that it rests on the periphery of the pool and is detachably secured or weighted down by weights accordingly such as shown in FIGS. 5 and 6.

Figure 5:
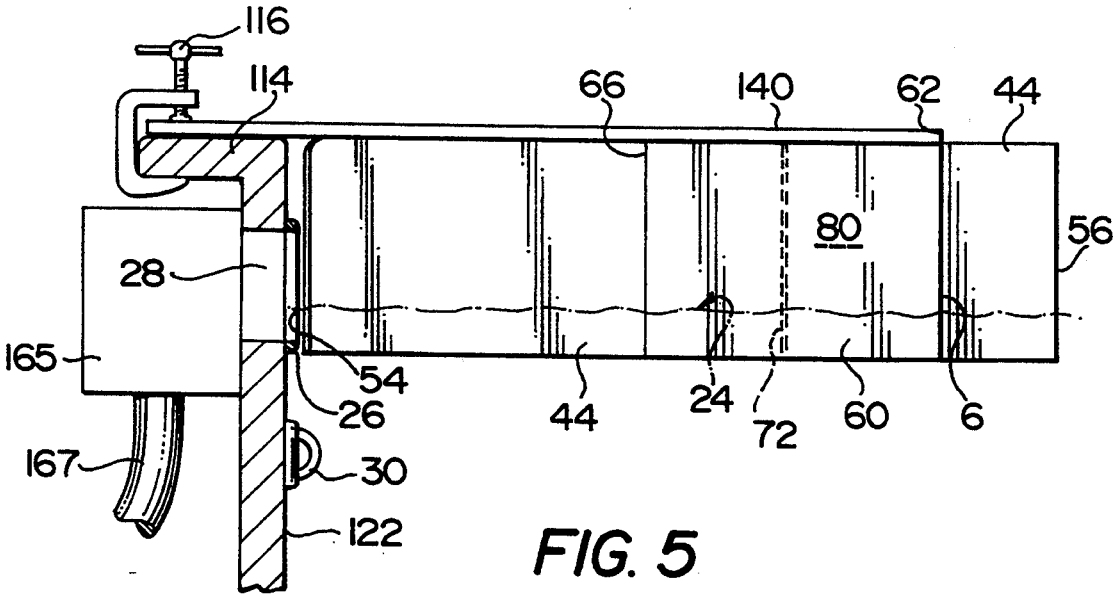
FIGS. 5 and 6 show in schematic section, variations on holding or securing the device to the side of a pool.

FIG. 5 shows in cross-section, part of an above-ground pool having pool wall 122 and upper lip or shoulder 114 to which plate 140 may be secured to clamps 116. Skimmer inlet 52 leads to a strainer device 165 common in the art, with hose 167 communicating with a pump (not shown).

Figure 6:
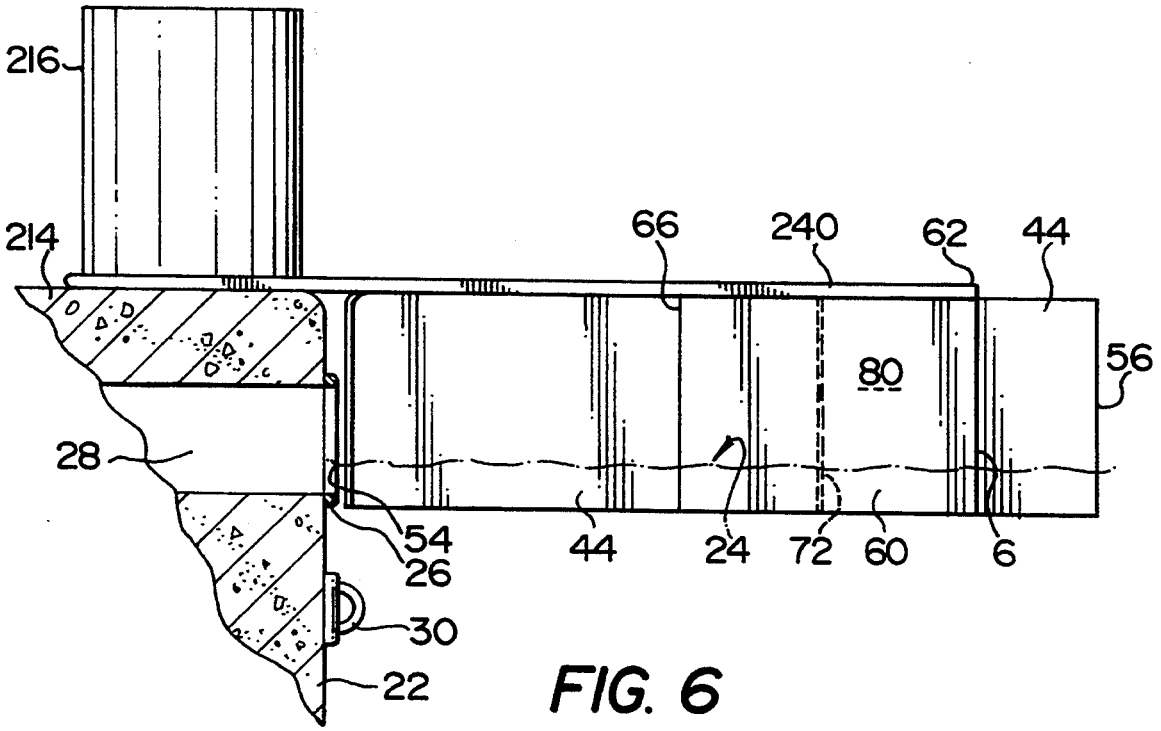

FIG. 6 shows in cross-section part of an inground pool having wall 222 wherein there is no coping. The end of plate 240 rests on surface 214 and weights 216, such as cylinder blocks, hold the plate in proper position. It will be noted that a notch, like notch 50, may not be required in embodiments such as those in FIGS. 5 and 6 but otherwise the apparatus is substantially the same as in FIGS. 1–4. It will be apparent that various other means of securing or mounting the apparatus adjacent the periphery of the pool is possible, depending on the nature of the pool periphery and its construction.

Any other means of detachably mounting plate 40 to coping 14 is contemplated. Indeed, any form of upper support is contemplated for plates 44, 60 and 70 and individual elongate brackets rather than plate 40 is also possible. It will also be appreciated that legs extending from the outer end of the device could rest on the pool bottom thereby eliminating pocket 76 as a flotation device and simply providing structural support for the inner end of the device. Since skimmers are often associated with the shallow end of a pool, an extensible leg, such as shown in dot-dash lines 180 in FIG. 1 and detachably secured to plate 70, is possible.

Further, for the purpose of marketing, packaging and shipping, the various plates may be constructed such that the device may come disassembled with instructions to assemble. A tongue and groove or dovetail construction for fitting the plates 44, 60 and 70 to support 40 could be used along with a pressure adhesive tape to seal the box 76 or styrofoam material to form flotation 80, if necessary.

Various other modifications in the construction of the device will be evident to those skilled in the art and all of them are contemplated which fall within the ambit of the claims set forth hereinafter.

The embodiments of the invention in which an exclusive property or privilege is claimed are defined as follows:

1. Apparatus for enhancing the surface cleaning of a swimming pool having a skimmer inlet in a wall of the pool, the inlet having side edges and top and bottom edges and the pool having peripheral water movement generally along the wall, comprising:

a first rigid plate having an upper edge, lower edge and inner and outer ends, the width of the first plate at the inner end being at least substantially equivalent to the depth of water in the pool from water level to the bottom edge of the skimmer inlet; and support means for supporting the first plate generally vertically adjacent the skimmer inlet wherein the upper edge of the first plate is above water level, the inner end of the first plate extends generally vertically downward intermediate the sides of said skimmer inlet and dividing it into upstream and downstream portions and said plate extends inwardly away from the skimmer toward the center of the pool at an angle with the pool wall in a direction opposite the direction of water movement, the lower edge of at least the inner end of the first plate being substantially adjacent the bottom edge of said skimmer inlet;

a second plate supported by said support means and extending outwardly from said first plate at an angle thereto wherein said apparatus is to be mounted on the wall of the pool adjacent said skimmer inlet such that said second plate slants in the direction of water flow and has its lower edge below water level and including flotation means for supporting the outer ends of said first and second plates in the pool;

said support means being a generally horizontal plate to which said upper edges of said first and second plates are secured and said flotation means comprises an air pocket formed by said horizontal plate, said first and second plates and by a third plate, said third plate extending vertically downwardly from the support plate and having its ends connected to portions of said first and second plates.

2. Apparatus for enhancing the surface cleaning of a swimming pool having a skimmer inlet in a wall of the pool, the inlet having side edges and top and bottom edges and the pool having peripheral water movement generally along the wall, comprising:

a first elongate rigid plate having upper and lower edges, first and second ends and opposed first and second substantially planar sides;

a second elongate rigid plate having first and second ends and upper and lower edges, said second plate having its first end secured to the second side of said first plate intermediate the ends of said first plate and extending outwardly from said second side of said first plate at an angle thereto;

support means comprising a generally horizontal plate which is attached to at least a substantial portion of the upper edges of said first and second plates for supporting said first and second plates in a pool wherein the first end of the first plate is located adjacent said skimmer inlet, said first plate extending inwardly away from the skimmer inlet toward the center of the pool with the first side of said first plate facing upstream relative to said water movement and said second rigid plate extends outwardly from the second side of said first plate in a direction downstream relative to said water movement.

3. The apparatus of claim 2, wherein the width of said second plate is substantially equal to the width of said first plate and the outer end of the first plate extends inwardly toward the center of the pool further than the end of said second plate.

4. The apparatus of claim 2 further including additional support means for supporting the second ends of said first and second plates in the pool.

5. The apparatus of claim 4 wherein said additional support means for supporting the second ends of said first and second plates is a flotation means.

6. The apparatus of claim 5 wherein said flotation means comprises means forming a closed air pocket adjacent a junction of said first and second plates.

7. In combination with a swimming pool having a skimmer inlet in a wall of the pool, the inlet having side edges and top and bottom edges and the pool having peripheral water movement generally along the wall, apparatus for enhancing the surface cleaning of the pool comprising:

a first elongate rigid plate having upper and lower edges, first and second ends and opposed first and second substantially planar sides;

a second elongate rigid plate having first and second ends and upper and lower edges, said second plate having its first end secured to the second side of said first plate intermediate the ends of said first plate and extending outwardly from said second side of said first plate at an angle thereto;

support means comprising a generally horizontal plate which is attached to at least a substantial portion of the upper edges of said first and second plates for supporting said first and second plates in a pool wherein the first end of the first plate is located adjacent said skimmer inlet intermediate the side edges and adjacent the bottom edge of said skimmer inlet, said first end of the first plate dividing the skimmer inlet into upstream and downstream inlet portions; and said first plate extending inwardly away from the skimmer inlet toward the center of the pool with the first side of said first plate facing upstream relative to said water movement and said second rigid plate extends outwardly from the second side of said first plate in a direction downstream relative to said water movement in the pool.

8. The combination of claim 7, wherein the second end of the first plate extends inwardly away from the skimmer inlet toward the center of the pool further than the second end of said second plate, the ends of the two plates causing eddy currents which tend to direct water downstream of the second plate toward the wall of the pool and the downstream inlet portion of the divided skimmer inlet.

9. The combination of claim 7 further including additional support means for supporting the second ends of said first and second plates in the pool.

10. The combination of claim 9 wherein said additional support means for supporting said second ends of said first and second plates in the pool is a flotation means.

11. The combination of claim 10 wherein said flotation means comprises means forming a closed air pocket adjacent a junction of said first and second plates.

* * * * *